United States Patent [19]

Koba et al.

[11] Patent Number: 4,975,618

[45] Date of Patent: Dec. 4, 1990

[54] DEFLECTION DEVICE FOR A COLOR PICTURE TUBE APPARATUS

[75] Inventors: Hiroyuki Koba, Fukaya; Hisakazu Okamoto, Kumagaya, both of Japan

[73] Assignee: Kabushiki Kaisha Toshiba, Kawasaki, Japan

[21] Appl. No.: 290,430

[22] Filed: Dec. 27, 1988

[30] Foreign Application Priority Data

Dec. 26, 1987 [JP] Japan ..... 62-330497
Mar. 4, 1988 [JP] Japan ..... 63-49740

[51] Int. Cl.[5] ..... H01J 29/06

[52] U.S. Cl. ..... 313/440; 313/421; 335/214; 315/85

[58] Field of Search ..... 313/440, 421; 315/85, 315/8; 335/214; 358/254

[56] References Cited

U.S. PATENT DOCUMENTS 3,349,271 10/1967 Harkensee ..... 315/8 X
4,677,344 6/1987 Toshiyasu et al. ..... 315/8 X
4,728,915 3/1988 Konosu et al. ..... 335/214 X

FOREIGN PATENT DOCUMENTS 3511162 10/1985 Fed. Rep. of Germany .
2476909 8/1981 France .
0189845 9/1985 Japan ..... 313/440
62-22361 1/1987 Japan .
62-73453 5/1987 Japan .
2076219 11/1981 United Kingdom ..... 313/440

OTHER PUBLICATIONS

Patent Abstracts of Japan, vol. 10 No. 32 (E-379) (2089), Feb. 7, 1986, Nippon Victor K.K. "Deflection York Journal of Applied Physics, vol. 44, No. 8 Aug. 1873, pp. 3766–3769 G. A. Wardly, "Correction of Eddy Current . . .".

*Primary Examiner*—Palmer C. DeMeo
*Attorney, Agent, or Firm*—Cushman, Darby & Cushman

[57] ABSTRACT

In a color picture tube apparatus, a deflection unit is provided around a color picture tube and a leakage magnetic is generated from the deflection unit. A metal cover made of aluminum, which covers an electrical power source is located in a space to which leakage magnetic field is reached and a first opposition magnetic field is generated from the metal cover due to the leakage magnetic field which produces an eddy current in the metal cover. A metal plate made of a conductive and non-magnetic material is so located between the deflection unit and the metal cover as to be substantially perpendicular to the metal cover. Thus, a second opposition magnetic field is so generated from the metal plate due to the leakage magnetic field as to substantially cancel the first opposition magnetic field.

18 Claims, 5 Drawing Sheets

DEFLECTION DEVICE FOR A COLOR PICTURE TUBE APPARATUS

Background of the Invention

1. Field of the Invention

The present invention relates to a color picture tube apparatus and, in particular, an improved deflection device for an in-line type CRT apparatus.

2. Description of the Related Art

In a television receiver or display apparatus, in general, an in-line type color picture tube with a deflection unit incorporated therein is located within a casing where associated electronic component parts are arranged. FIG. 1 shows an in-line type color picture tube incorporating a deflection unit therein. In inline type color receiver tube 1, funnel 3 equipped with neck 5 is joined to panel 2 to provide vacuum glass envelope 4. In in-line type electronic gun assembly (not shown), three electron guns are located within neck 5 in a horizontal direction X to emit three electron beams. On the inner surface of a face plate of panel 2, red, blue and green phosphor stripes or dots are arranged to form a phosphor screen which emits red, blue and green phosphor light rays when the electron beams landed thereon. A shadow mask is positioned opposite to the phosphor screen and supported in panel 2. Deflection unit 7 is arranged at a location from neck 5 to funnel 3 to generate a deflection magnetic field for deflecting the electron beams. Deflection unit 7 comprises a pair of saddle type horizontal deflection coils 8 and a pair of toroidal type vertical deflection coil 10 wound on core 9.

Color picture tube 1 equipped with deflection unit 7 is incorporated into a casing as shown in FIG. 2 to provide a television receiver set or display apparatus. As recent television receiver sets, for example, a high-resolution color display apparatus become more and more compact, more power source circuit units or a power source unit for a video unit, are often provided nearer to deflection unit 7. FIG. 2 shows an arrangement where power source unit 11 is provided in the neighborhood of deflection unit 7. In power source unit 11, a power source circuit is covered with metal cover 12, made up of an iron sheet or an aluminum sheet, to prevent the radiation of any spurious electromagnetic wave. In this case, metal cover 12 serves also as a support structure for supporting the power source circuit. In the case where power source unit 11 is disposed in the neighborhood of deflection unit 7, an eddy current is induced in metal cover 12 due to a leakage, magnetic field coming from deflection unit 7, so that a magnetic field resulting from the creation of the eddy current penetrates the color picture tube, adversely affecting the deflection track of the electron beams so that misconvergence will locally be produced on the TV screen. That is, as shown in FIGS. 3A and 3B, toroidal type vertical coil 10 which is wound on core 9 of deflection unit 7 is such that an effective deflection magnetic field 13 for deflecting electron beams is produced within the picture tube. A part of the magnetic field is produced as a leakage magnetic field 14 from the vertical deflection coil 10 to the outside of the picture tube. Leakage magnetic field 14 penetrates a part of metal cover 12 which covers power unit 11 situated in the neighborhood of deflection coil 10 so that eddy current is produced thereon. In the picture tube described above, if vertical deflection coil is energized with an ordinary deflection voltage whose vertical scanning frequency is as low as 40 to 100 Hz, no greater eddy current occurs relative to metal cover 12. In the case where there is an adequate spacing between deflection coil 10 and metal cover 12, any magnetic field which is produced due to the presence of the eddy current exerts almost no influence over the deflection beam track. In a recent high-resolution color display apparatus, the tendency is toward shortening the retrace time for a vertical scanning, which corresponds to that vertical deflection coil 10 is energized with a vertical deflection voltage whose vertical scanning frequency is as high as 10 KHz. In the recent high-resolution color display apparatus, relatively great eddy current 15 is produced relative to metal cover 12 and a demagnetizing field 16 is generated due to that eddy current 15, reaching that portion of deflection unit 7 which is situated on the side of the electron guns. Hence there is a risk that an averse influence will be inflicted on the electron beams. In the arrangement shown in FIGS. 2 and 3A, there is a risk that demagnetizing field 16 acts in a direction in which the deflection increases relative to a side electron beam on the right side, in particular, in these Figures. As a result, there is a risk that misconvergence, that is, an excess deflection of the electron beams over the electron beams, will emerge on the viewing screen as shown in FIG. 4. It has been recognized that such misconvergence occurs locally only at that top edge of the screen which is subjected to influence during the retrace period. The misconvergence is about 0.1 to 0.3 mm for an 14-inch 90°-angle display tube for instance and occurs only within a range of about 5 mm from the top edge of the screen. An external correction is very difficult to make in view of the fact that an error due to this misconvergence is local in nature. This gives a viewer an impression that the convergence is degraded on the whole surface of the screen of a high-resolution display tube which demands a misconvergence, if any, as low as below 0.3 to 0.4 mm.

SUMMARY OF THE INVENTION

It is accordingly an object of the present invention to provide an improved deflection device for an in-line type color CRT which can reduce the generation of misconvergence to a minimum possible extent.

According to the present invention there is provided a color picture tube apparatus with a power source unit comprising a color picture tube including, a vacuum envelope composed of a neck, funnel and a panel having a face plate, an electron gun assembly arranged in an inline array within the neck and including three electron guns for emitting corresponding electron beams, deflection means, located on the neck and the funnel, for generating an effective magnetic field which deflects the electron beams emitted from the electron gun assembly within the vacuum envelope, a screen formed on the face plate which is scanned by deflected electron beams and landed by them to generate light rays, an electrical conductive cover, located in a space to which a leakage magnetic field generated from said deflecting means is reached, for covering the power source unit which drives the color picture tube, a first opposition magnetic field being generated from said electrical conductive cover by the leakage magnetic field, and compensating means, located in the space to which the leakage magnetic field is reached, for generating a second opposition magnetic field which compensates the first opposition magnetic field.

According to another embodiment of the present invention, a color picture tube apparatus provided with an electroconductive metal cover having a surface comprises a color picture tube including, a vacuum envelope having a neck, a funnel and a panel provided with a face plate, an electron gun assembly arranged in an in-line array within the neck and including three electron guns for emitting corresponding electron beams, deflection means, located on the neck and the funnel, for generating an effective magnetic field which deflects the electron beams emitted from the electron gun assembly within the vacuum envelope, a screen mounted on a face plate which is scanned by deflected electron beams and landed by them to generate light rays, and a member located between the electroconductive metal cover and the deflection means and having a surface which generates a compensation magnetic field for compensating an opposite magnetic field generated from the electroconductive metal cover, the surface being arranged substantially perpendicular to the surface of the electroconductive metal cover, and said member being made of non-magnetic electroconductive metal.

According to another embodiment of the present invention, a color picture tube apparatus comprises a color picture tube including, a vacuum envelope having a neck, a funnel and a panel provided with a face plate, an electron gun assembly arranged as an in-line array within a neck and including three electron guns for emitting electron beams, deflection means, located on the neck and the funnel, for generating an effective magnetic field which deflects electron beams emitted from the electron gun assembly within the vacuum envelope, a screen mounted on the face plate which is scanned by deflected electron beams and landed by them to generate light rays, and a non-magnetic electroconductive metal member facing the electroconductive metal cover with the deflection means therebetween, for generating a compensating magnetic field which compensates an opposition magnetic field generated from the electroconductive metal cover.

DETAILED DESCRIPTION OF THE PREFERRED EMBODIMENT

Figure 1:
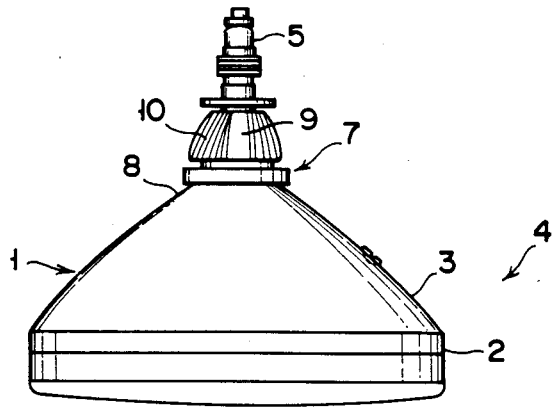
FIG. 1 PRIOR ART
FIG. 1 is a plan view diagrammatically showing a conventional color picture tube.
Figure 2:
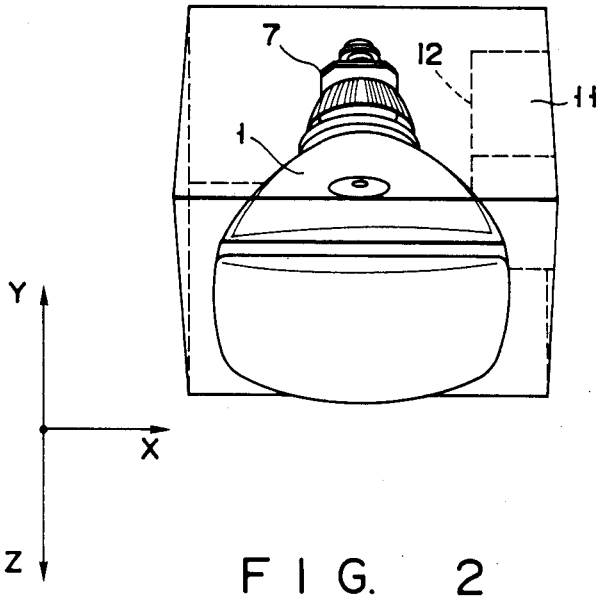
FIG. 2 PRIOR ART
FIG. 2 is a perspective view diagrammatically showing a display apparatus incorporating the conventional color picture tube shown in FIG. 1.
Figure 3A:
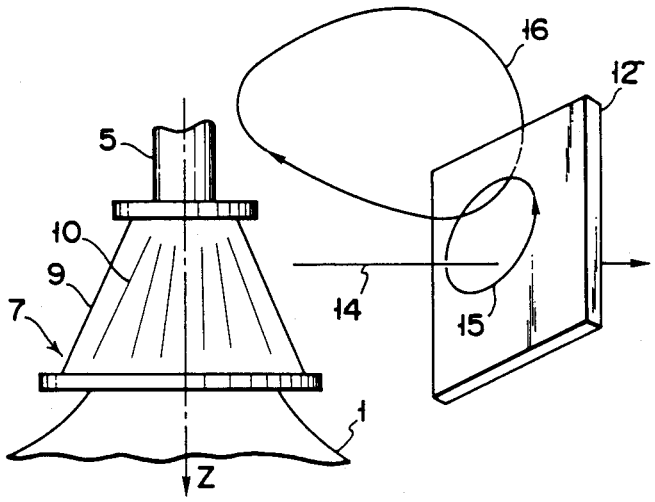
FIG. 3A (PRIOR ART)
FIGS. 3A and 3B are explanatory views showing a distribution of a leakage magnetic field near to, and from, a deflection unit of the color picture tube as shown in FIGS. 1 and 2 and an eddy current induced by the leakage magnetic field at a casing of the power source unit.
Figure 3B:
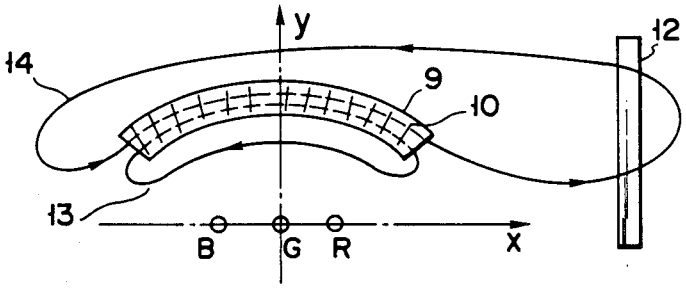
FIG. 3B (PRIOR ART)
Figure 4:
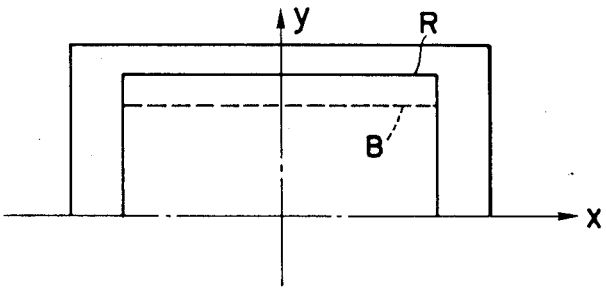
FIG. 4 (PRIOR ART)
FIG. 4 is an explanatory view for showing misconvergence produced on a screen due to an eddy current generated at the casing of the power source unit.
Figure 5:
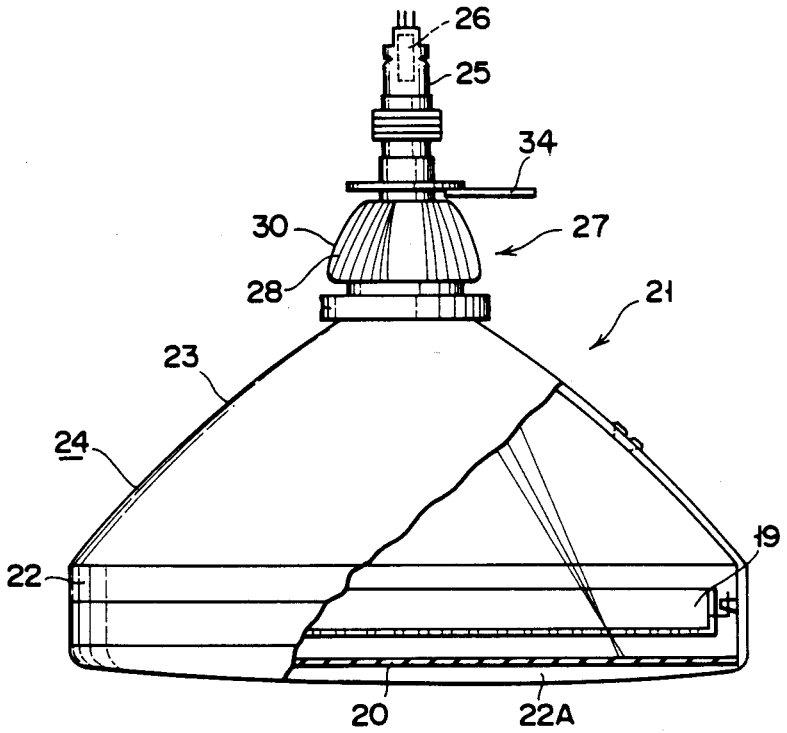
FIG. 5 is a plan view, partly broken away, diagrammatically showing a color picture tube according to one embodiment of the present invention.
Figure 6:
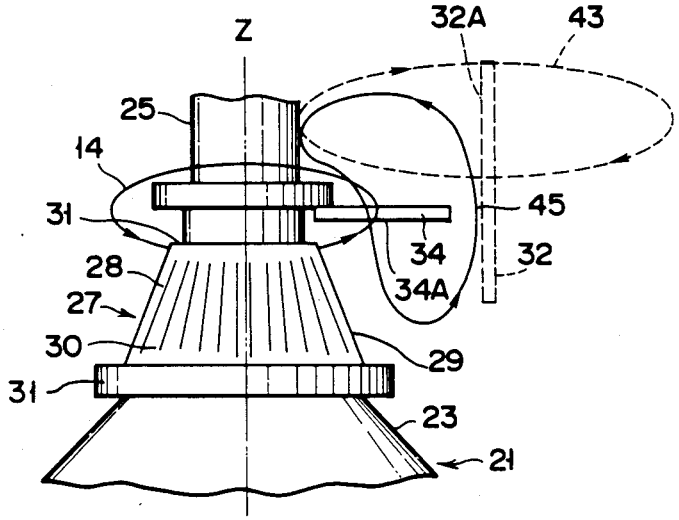
FIGS. 6 and 7 show a distribution of a leakage magnetic field near to, and from, a deflection unit of the color picture tube shown in FIG. 5, an eddy current produced by a leakage magnetic field at the casing of a power source unit and a demagnetizing field produced by the leakage magnetic field at the casing of a power source unit.
Figure 7:
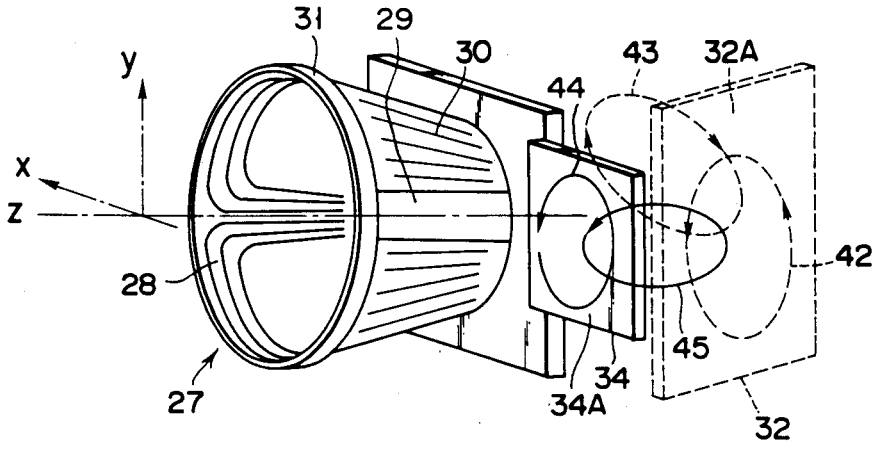

FIG. 5 shows an improved deflection unit-equipped in-line type color receiver tube apparatus according to one embodiment of the present invention. In in-line type color picture tube 21, funnel 23 having neck 25 is joined to panel 22 to provide vacuum glass envelope 24. Three electron guns for emitting the corresponding electron beams are arranged within neck 25 in a horizontal direction to provide in-line type electron gun assembly. On that inner surface of face plate 22A of panel 22 facing electron gun 26, phosphor stripes are formed where electron beams are landed to allow red, blue and green beams to be produced. Shadow mask 19 is located relative to phosphor screen 20 with a greater number of apertures formed opposite to phosphor screen 20. Shadow mask 19 is supported by panel 22. Deflection unit 27 for deflecting electron beams is arranged at a location from neck 25 to funnel 23. Deflection unit 27 comprises, as shown in FIG. 6, a pair of saddle type horizontal deflection coils 28 for deflecting electron beams in the horizontal direction and a pair of vertical deflection coils 30, wound as a toroidal type on core 29, for deflecting electron beams in the vertical direction. Deflection unit 27 is assembled as a saddle/toroidal type deflection unit, as shown in FIG. 7, where a pair of saddle type horizontal deflection coils 28 are located within frusto-conical separator 31 made of an insulating resin and the pair of toroidal type vertical deflection coil 30 wound on a core 29 which is situated outside separator 31. Color picture tube 21 with deflection unit 27 attached thereto is housed in a casing, not shown, to assemble a display apparatus or the television receiver set. As shown in FIGS. 6 and 7, upon assembling the color picture tube apparatus into the displaying device or television receiver set, metal cover 32 made of aluminum or stainless steel and covering a video unit or a power source section of the display apparatus is disposed at the right-side space of the color picture tube apparatus as viewed from the side of screen 20. Metal cover 32 is made of, for example, a 1.0 mm-thick aluminum plate whose dimension is 150 mm$\times$150 mm as an area of a surface 32A which faces the deflection unit. In the embodiment of the present invention, the electron guns for generating center and side electron guns to be landed onto red, green and blue phosphor stripes as viewed from the side of phosphor screen 20 are arranged, assuming that the electron beams are deflected toward an upper zone of the phosphor screen.

In the color picture tube, metal plate 34 made of a good conductor of non-magnetic material is located between deflection unit 27 and metal cover 32 such that its surface 34A is substantially perpendicular to surface 32A of metal cover 32 facing the deflection unit. Metal plate 34, if being too thin, is not preferable upon creating an eddy current. Metal plate 34 is required to have a thickness of over 0.3 mm and, preferably, within a selected range of 0.3 to 2.0 mm. Surface 34A of metal plate 34 has preferably a smaller area than that of surface 32A of metal cover 32.

In the aforementioned color picture tube, if horizontal and vertical deflection currents are supplied from a deflection signal generator circuit, not shown, to deflection unit 27, then deflection unit 27 is energized, causing an effective deflection magnetic field which deflects electron beams to be generated from vertical deflection coil 28 of deflection unit 27 along the horizontal axis y within the color picture tube. In addition to the generation of effective deflection magnetic field 13, leakage magnetic field 14 having horizontal and axial magnetic components along the horizontal axis X and tube axis Z is also generated outside the color picture tube from deflection unit 27. The horizontal component of leakage magnetic field 14 passes through metal cover 32 which is situated near to vertical deflection coil 30. As a result, eddy current 42 is generated as surface 32A, causing first opposition field 43 to be produced from metal cover 32 toward neck 25 of color picture tube 21. Similarly, the axial component of leakage magnetic field 14 passes through metal plate 34 attached to vertical deflection coil 30, creating eddy current 44 at surface 34A. As a result, second opposition magnetic field 45 is created by eddy current 44 from metal plate 34 toward neck 25 of color picture tube 21. The first and second opposition fields 43 and 45 are created within neck 25 of color picture tube 21, but in the mutually opposite directions. The size and thickness of metal plate 34, if being properly selected, allow the first and second magnetic fields to be cancelled with respect to each other. This feature can eliminate a risk of producing misconvergence on the screen.

Figure 8:
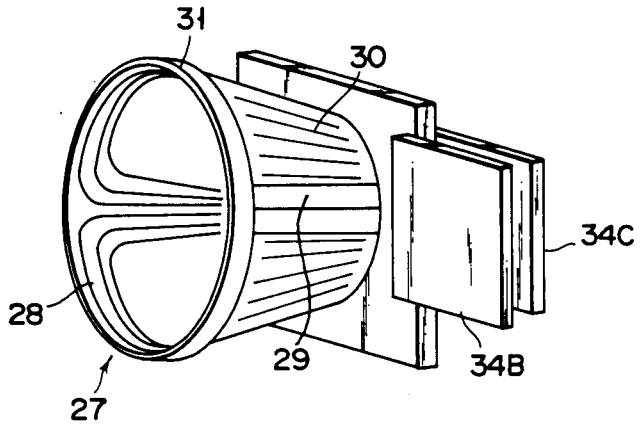
FIG. 8 is a perspective view diagrammatically showing a deflection unit for a color picture tube according to a modified embodiment of the present invention.

Metal plate 34 shown in FIG. 8 need not be restricted to only a single metal plate. A plurality of metal plates 34B, 34C may be arranged, as shown in FIG. 8, between deflection unit 27 and metal cover 32 such that surfaces 34A of metal plates 34B, 34C are substantially perpendicular to surface 32A of metal cover 32 facing the deflection unit 27. In the color picture tube as shown in FIG. 8, a smaller space is defined between deflection unit 27 and metal cover 32 and, even if a space adequate enough to dispose greater metal plate 34 is not left, the intensity of the second demagnetizing field can be adjusted by a plurality of metal plates.

In the cathode ray tube as shown in FIGS. 7 and 8, although metal plate 34 and metal cover 32 are disposed on the right side as viewed from the phosphor screen side, it is clear that metal plate 34 is located on the left side as viewed from the screen side in the case where cover 32 of the power source unit is disposed on the left side as viewed from the screen side.

Another embodiment of the present invention will be explained below with reference to FIGS. 9 and 10.

In the case where metal cover 32 is disposed on the right side toroidal type vertical deflection coil 30 as viewed from the phosphor screen side, metal plate 34 made up of a good conductor is disposed on the left-side of the deflection unit as viewed from the screen side such that it extends along the tube axis over an area facing both core 29 and part of neck 25. In this case, metal plate 34 is disposed with its widest surface located opposite to metal cover 32 with the deflection unit therebetween. Metal plate 34 is made up of a 1.0 mm-thick aluminum plate having a dimension of about 50 mm×40 mm.

Figure 9:
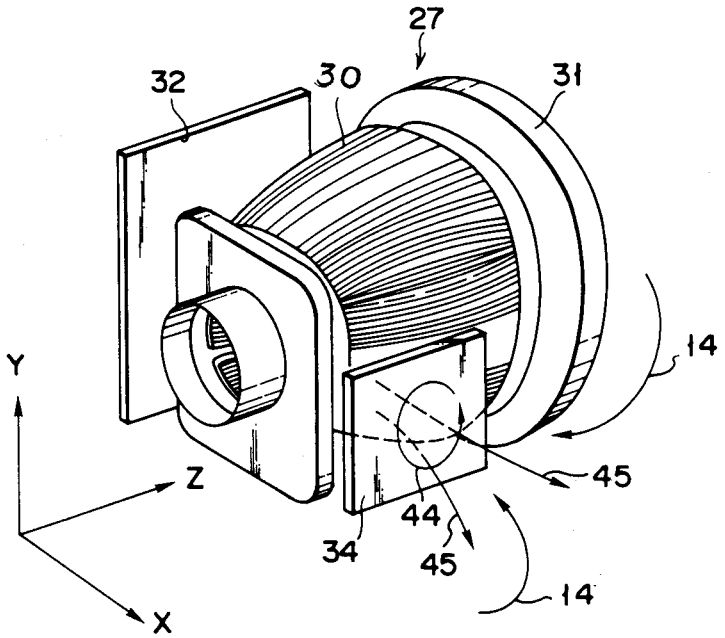
FIG. 9 is a perspective view diagrammatically showing a deflection unit for a color picture tube according to a modified embodiment of the present invention.
Figure 10:
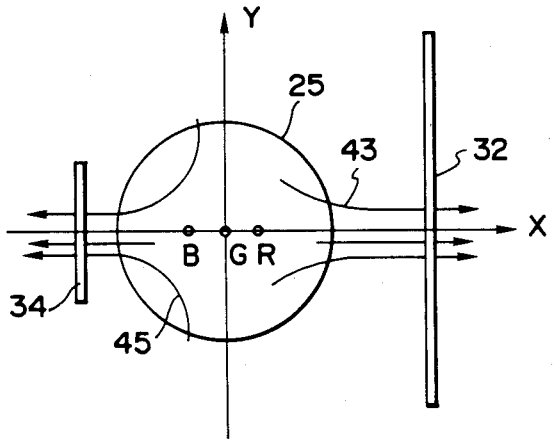
FIG. 10 shows first and second demagnetizing field distributions at a neck of the color picture tube.

In the embodiment with metal plate 34 attached thereto, the horizontal component of leakage magnetic field 14 of toroidal type vertical deflection coil 30 penetrates metal plate 34 as shown in FIG. 9, causing an eddy current 44 to be induced at surface 34A of metal plate 34. By the eddy current 44, second demagnetizing field is created from metal plate 34, penetrating neck 25 of color picture tube 21. First opposition field 43 is created from metal cover 32 toward neck 25 of picture tube 21. Within neck 25, first and second opposition fields 43 and 45 are produced in opposite directions, respectively. Within neck 25, the first and second demagnetizing fields 43, 45 can be set to have a substantially same intensity level by properly selecting the size and thickness of metal plate 34. That is, an excessive deflection affecting on the red electron beam, which is produced by first opposition magnetic field 43 can be substantially same level as that affection on the blue electron beam, which is produced by second opposition magnetic field 45 so that the effect of first opposition magnetic field 43 is corrected by second opposition magnetic field 45. Since metal plate or plate-like member 34 is provided, it is possible to eliminate a risk of producing misconvergence on the screen.

It is preferable that conductive metal plate 34 extend, while facing both a portion of 29 and a portion of neck 25 where core 29 is not present. If, for example, metal plate 34 made up of good conductor faces core 29 only, there is a risk that, since second demagnetic field 45 is interrupted by core 29 while leakage magnetic field 14 penetrates metal plate 34, leakage magnetic field 14 will not be able to adequately correct an effect of first opposition magnetic field 43 at neck 25. If, on the other hand, metal plate 34 made of a good conductor is disposed in a manner to face neck 25 only, leakage magnetic field 14 is adequately not applied to metal plate 34, offering a risk of failing to adequately correct an effect of first opposition magnetic field 43 at neck 25.

However, the extent of correction, that is, second opposite field 45 can freely be set by the size of metal plate 34 and distance from the deflection unit. According to the color picture tube shown in FIG. 9, it has been found that any misconvergence which otherwise might occur on the order of 0.2 mm on the cathode ray tube not equipped with metal plate 34 can be reduced to substantially zero.

Although, in the aforementioned embodiment, an explanation has been made of the deflection unit having a toroidal type vertical deflection coil for producing an extra-great leakage magnetic field, it will be appreciated that the present invention can be applied to the deflection unit having a saddle type vertical deflection coil.

What is claimed is:

1. A color picture tube apparatus with a power source unit comprising:

a color picture tube including:

a vacuum envelope composed of a neck, funnel and a panel having a face plate;

an electron gun assembly arranged in an in-line array within the neck and including three electron guns for emitting corresponding electron beams;

deflection means, located on the neck and the funnel, for generating an effective magnetic field which deflects the electron beams emitted from the electron gun assembly within the vacuum envelope;

a screen formed on the face plate which is scanned by deflected electron beams and landed by them to generate light rays; and an electrical conductive cover, located in a space to which a leakage magnetic field generated from said deflecting means is reached, for covering the power source unit which drives the color picture tube, a first opposition magnetic field being generated from said electrical conductive cover by the leakage magnetic field, and compensating means, located in the space to which the leakage magnetic field is reached, for generating a second opposition magnetic field which compensates the first opposition magnetic field.

2. The color picture tube apparatus according to claim 1, wherein said compensating means is made of a non-magnetic electroconductive metal.

3. The color picture tube apparatus according to claim 2, wherein said non-magnetic electroconductive metal plate is arranged substantially perpendicular to said conductive cover.

4. The color picture tube apparatus according to claim 2, wherein said non-magnetic metal plate is arranged substantially parallel to said conductive cover.

5. The color picture tube apparatus according to claim 4, wherein said non-magnetic electroconductive metal plate is so arranged as to face said deflection means and said neck.

6. The color picture tube apparatus according to claim 1, wherein said deflection means includes vertical deflection means for generating an effective magnetic field for vertically deflecting electron beams and a leakage magnetic field.

7. The color picture tube apparatus according to claim 3, wherein said compensating means generates an eddy current due to a leakage magnetic field from a vertical deflection means to allow generation of the second opposition field due to that eddy current.

8. A color picture tube apparatus provided with an electroconductive metal cover having a surface, comprising:

a color picture tube including:

a vacuum envelope having a neck, a funnel and a panel provided with a face plate;

an electron gun assembly arranged in an in-line array within the neck and including three electron guns for emitting corresponding electron beams;

deflection means, located on the neck and the funnel, for generating an effective magnetic field which deflects the electron beams emitted from the electron gun assembly within the vacuum envelope; and a screen mounted on a face plate which is scanned by deflected electron beams and landed by them to generate light rays, and a member located between the electroconductive metal cover and the deflection means and having a surface which generates a compensation magnetic field for compensating an opposite magnetic field generated from the electroconductive metal cover, the surface being arranged substantially perpendicular to the surface of the electroconductive metal cover, and said member being made of non-magnetic electroconductive metal.

9. The color picture tube apparatus according to claim 8, wherein said non-magnetic electroconductive metal is formed as a plate-like member.

10. The color picture tube apparatus according to claim 8, wherein said deflection means includes a vertical deflection means for generating an effective magnetic field for deflecting electron beams in a vertical direction and a leakage magnetic field.

11. The color picture tube apparatus according to claim 10, wherein said non-magnetic electroconductive metal member generates an eddy current resulting from a leakage magnetic field from said vertical deflection means, producing a compensating magnetic field.

12. The color picture tube apparatus according to claim 8, wherein said leakage magnetic field generated from said deflection means allows generation of an eddy current at said electroconductive metal member, thereby allowing an eddy current to be generated due to the leakage magnetic field, the opposition magnetic field being generated due to the eddy current.

13. The color picture tube according to claim 8, wherein said non-magnetic electroconductive member is divided into a plurality of segment plates.

14. A color picture tube apparatus having an electroconductor metal cover for housing a power source of a video unit, comprising:

a color picture tube including:

a vacuum envelope having a neck, a funnel and a panel provided with a face plate;

an electron gun assembly arranged as an in-line array within the neck and including three electron guns for emitting electron beams;

deflections means, located on the neck and the funnel, for generating an effective magnetic field which deflects electron beams emitted from the electron gun assembly within the vacuum envelope; and a screen mounted on the face plate which is scanned by deflected electron beams and landed by them to generate light rays, and a non-magnetic electroconductive metal member facing the electroconductive metal cover with the deflection means therebetween, for generating a compensating magnetic field which compensates an opposition magnetic field generated from the electroconductive metal cover.

15. The color picture tube apparatus according to claim 14, wherein said non-magnetic electroconductive metal member is constructed of a plate-like member.

16. The color picture tube apparatus according to claim 14, wherein said non-magnetic electroconductive metal member is so arranged as to face said deflection means and said neck.

17. The color picture tube apparatus according to claim 14, wherein said deflection means includes vertical deflection means for generating an effective magnetic field for deflecting electron beams in a vertical direction and a leakage magnetic field.

18. The color picture tube apparatus according to claim 17, wherein said non-magnetic electroconductive metal member allows generation of an eddy current resulting from a leakage magnetic field from said vertical deflection means, generating the opposition magnetic field.

* * * * *